United States Patent [19]

Rasmussen et al.

[11] Patent Number: 4,568,300

[45] Date of Patent: Feb. 4, 1986

[54] TOY TEAM RACING SET

[75] Inventors: Russell G. Rasmussen, Skokie; Harry Disko, South Barrington, both of Ill.

[73] Assignee: Marvin Glass & Associates, Chicago, Ill.

[21] Appl. No.: 691,748

[22] Filed: Jan. 15, 1985

[51] Int. Cl.[4] ..... A63H 33/26; A63H 18/14

[52] U.S. Cl. ..... 446/129; 446/445; 446/446; 446/457; 273/86 B

[58] Field of Search ..... 446/446, 444, 445, 465, 446/431, 451, 455, 454, 129, 457, 433; 273/86 B

[56] References Cited

U.S. PATENT DOCUMENTS 2,159,974 5/1939 Lohr ..... 446/431 X
2,782,559 2/1957 Strauss ..... 446/451
3,407,533 10/1968 Hughes ..... 446/467
3,571,970 3/1971 Dunn ..... 446/451

FOREIGN PATENT DOCUMENTS 432797 8/1926 Fed. Rep. of Germany ..... 446/465

*Primary Examiner*—Mickey Yu
*Attorney, Agent, or Firm*—John S. Pacocha

[57] ABSTRACT

A toy slot car racing set is provided with linked, lead and follower car teams. The link is resilient and has a width substantially greater than the thickness, to provide some resistance to lateral flexing. Tight fits between a pin and aperture connection of each end of a link to a respective vehicle generally maintains the connected end of the link in a fixed angular relationship to the vehicle.

20 Claims, 7 Drawing Figures

TOY TEAM RACING SET

BACKGROUND ART

1. Field of the Invention

This invention relates generally to propelled toy vehicles and more particularly to simulated team racing vehicle sets.

2. Background Art

Propelled toy vehicles have long been used in play situations simulating chases and races. Slot car race sets have been a particularly popular form of propelled toy vehicles used for race play. The coupling of a propelled toy vehicle with a drone vehicle for simulating chase play has been used in situations where the movement of the vehicles are not restrained by a track. Examples of such prior art linked cars are found in U.S. Pat. Nos. 2,782,559, British Patent Application 746,262 and German Pat. No. 1,914,792 as well as in co-pending U.S. application Ser. No. 462,753 assigned to the same assignee as this application. Such prior art linked vehicles, all of which have a substantially rigid connecting bar between the powered vehicle and the drone vehicle, are not well suited for simulated race play on a track. Accordingly there remains a need for linked toy vehicles for simulated race play on slot car tracks.

SUMMARY OF THE INVENTION

The present invention is concerned with providing toy slot car racing team vehicle sets. This and other objects and advantages of the invention are achieved by providing a powered lead towing vehicle and a drone vehicle with a resilient tow link. In order to control lateral movement of the drone vehicle, the tow link is, in cross section, substantially wider than it is high.

BRIEF DESCRIPTION OF THE DRAWING

For a better understanding of the present invention reference may be had to the accompanying drawing in which.

DETAILED DESCRIPTION OF THE PREFERRED EMBODIMENT

Figure 1:
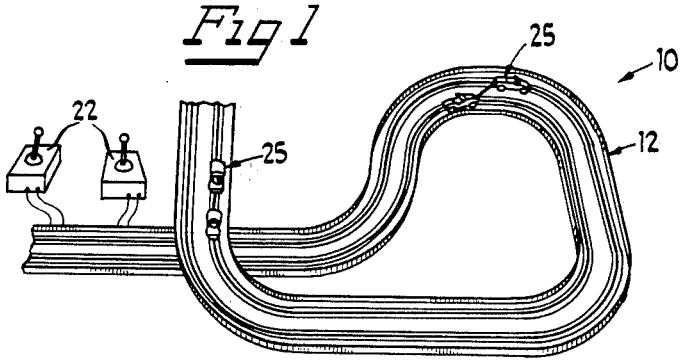
FIG. 1 is a perspective view of a portion of a slot car racing set embodying the present invention.
Figure 2:
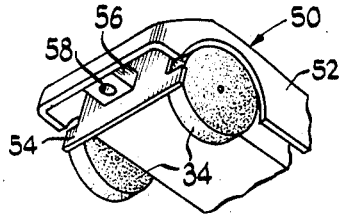
FIG. 2 is an enlarged scale perspective view of the drone vehicle.

Referring now to the drawing in which like parts are designated by like reference numerals thoughout the several views, there is shown in FIG. 1 a portion of a slot car racing set 10 having a track 12 made up of a number of connectable straight and curved sections. As in commercially available slot car racing sets, each track section has a generally flat roadbed 14 with substantially parallel, spaced apart slots 16. On either side of each slot 16, and parallel to the slot, are contact strips 18. Extending upwardly from the outside edge of each track section is a retaining sidewall 20 which, for toy cars that are approximately three and one-quarter inches long by one and one-half inches wide with wheel diameters of about one-half inch and a wheelbase of about one and one-half inches, are generally three-eights of an inch on straight sections of track and up to about one-half inch high on curved sections. The track sections are connected together both mechanically and electrically as in commercially available slot car sets. A separate controller 22, connectable to normal household line current, is electrically connected to a respective set of track contact strips 18.

Race set 10 is provided with race car teams 25. Each team has a lead, powered, tow car 30 with a body 32 that may be of any convenient race car styling. As in commercially available slot car sets, the car has wheels 34 made of a soft rubber material having a high coefficient of friction. The soft rubber wheels 34 are preferably inboard of the body 32 of the car which is made of a considerably harder plastic such as polystyrene or polyethylene. Lead car 30 is provided with an electrical motor 36 which obtains electrical power through brushes or wipers 38 that are in electrical contact with one pair of strips 18. The motor 36 is drivingly connected to the rear set of wheels. A depending guide pin 40 rides in the slot 16 between the respective contact strips. As long as the friction between the wheels 34 and the roadbed 14 is not overcome by centrifugal force as the car speeds through curves, the car is maintained within a particular defined path around the track. Behind the rear set of wheels is a downwardly depending rear guard plate 42. Extending back from the guard plate 42 within the body 32 is a generally horizontally disposed boss 44 with an aperture 46.

One or more motorless drone cars 50 are provided for each race team 25. Each drone has a hard plastic body 52 that may conveniently be styled, or have a color, the same as the body 32 of the lead car to identify them as a team. Drones 50 may have the same high coefficient of friction wheels 34 as the powered lead tow car 30 but they are free wheeling. Ahead of the front set of wheels is a downwardly depending guard plate 54 with a forwardly extending generally horizontally disposed boss 56 having an aperture 58. A rear guard plate 60 depends behind the rear wheels and a generally horizontal disposed boss 62 with an aperture 64 extends behind plate 60 within the body shell 52. Since the drone cars 50 do not have a motor, a weight or magnet 66 may be included to increse the stability of the towed drone cars but still permit the drone to change lanes as a result of centrifugal force when the lead car enters a curve.

Figure 5:
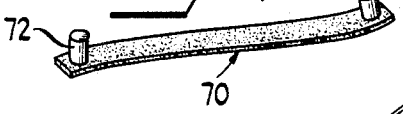
FIG. 5 is an enlarged scale perspective view of a tow link.

Interconnecting the lead tow car 30 and the drone 50 is resilient tow link 70 that is preferably longer than the vehicle wheelbase or about two inches long. Rubber, or more particularly black Kraton polymer 3200 with a hardness of Shore 70–75 is used for the tow link. As is perhaps best illustrated in FIG. 5, the tow link has a substantially greater width than the height or thickness of the link. A width of at least twice the height or thickness has been found to work well with toy cars that are about three and one-quarter inches long. Projecting upwardly from adjacent each end of thelink 70 is a pin 72 that fits tightly into one of the apertures 46, 58 or 64 in order to connect a lead tow car 30 with a drone 50 or one drone with another following drone. Alternatively the lead car and the drone car may be provided with pins that would fit tightly into apertures in the tow link.

The tight fit maintains the connected end of the link in a fixed angular relationship with the car to which it is connected.

Figure 3:
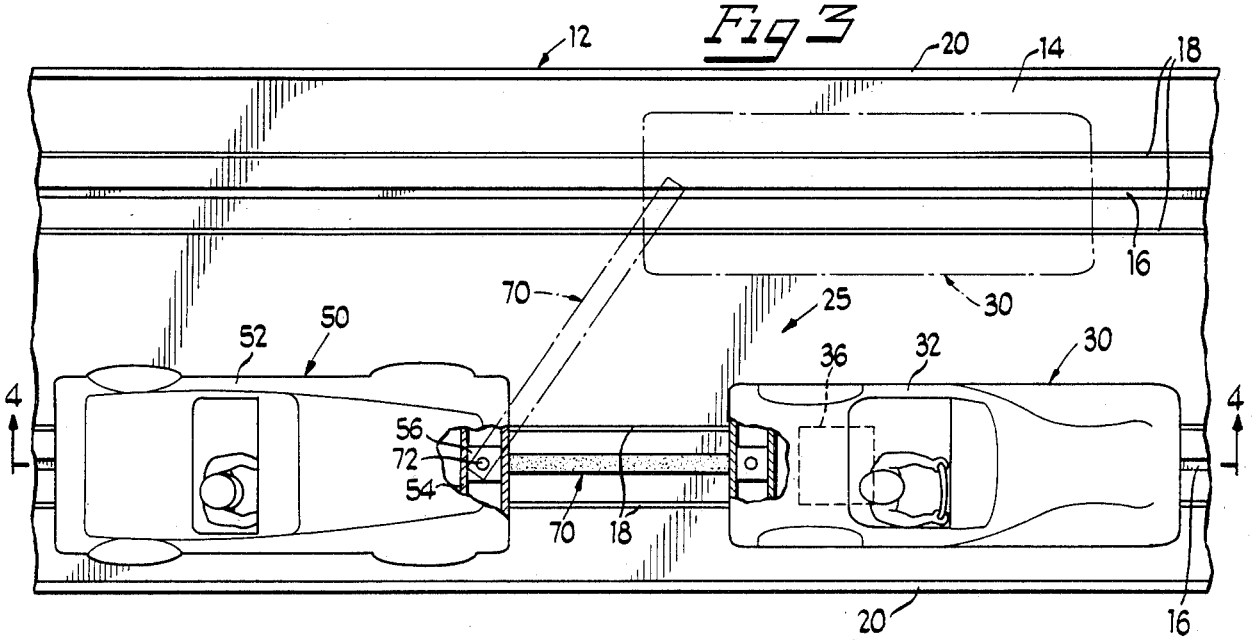
FIG. 3 is an enlarged scale top pla view showing a portion of a slot car track with part of the vehicles broken away.
Figure 4:
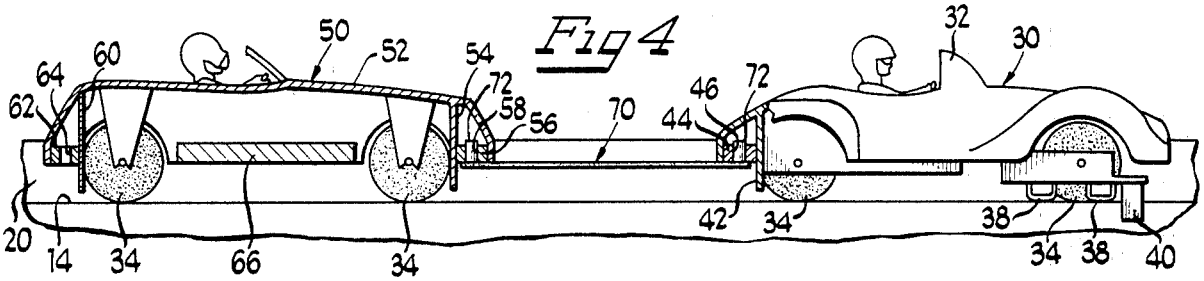
FIG. 4 is a sectional view taken generally along the line 4—4 of FIG. 3.
Figure 6:
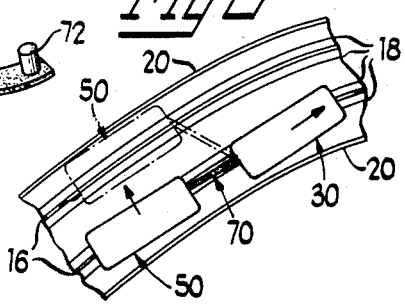
FIG. 6 is a top plan view of a portion of curved track with schematic showings of the vehicles.
Figure 7:
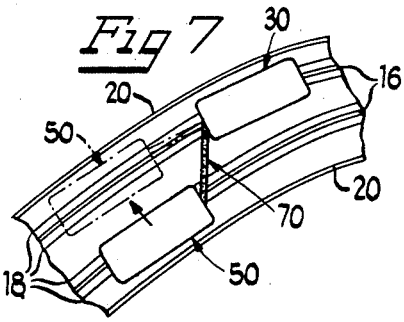
FIG. 7 is a top plan view of a portion of curved track with schematic showings of the vehicles.

Because of the tight fit of each of the pins 72 in any one of the apertures 46, 58 and 64 plus the relatively greater lateral stability or rigidity of the link 70 resulting from the greater width, the towed drone 50 is maintained in a generally fixed lateral relationship with respect to the lead car 30 except in curved portions of the track. The lead and follower vehicles may be linked one behind the other or in parallel, as illustrated in FIG. 3. When the vehicles are linked one behind the other, the resulting centrifugal force as the lead car 30 goes along the inside slot of a curve will throw the drone car 50 into the outside lane as is schematically shown in FIG. 6. However, when the vehicles are linked as illustrated in phantom in FIG. 3, and the lead car 30 is in the outside slot of a curve, the drone 50 normally positioned by the link in the inside slot will tend to swing out into the outside slot as is illustrated in FIG. 7. Since the drone-car will always tend to be forced outside by centrifugal force, the retaining sidewalls 20 are particularly necessary in the curves. Linking the cars one behind the other permits passing by an opponent in the straightaways while setting the link at an angle will limit permitted passing to those curves in which the opponent has the inside lane.

In race simulating play the towed drone car can be used to block an opponent from passing. Of course, such blocking will sometimes result in crashes which may further enhance play. It has been found that there are less crashes when the hard plastic bodies of the vehicles contact each other as opposed to the softer, higher coefficient of friction, wheels. Accordingly as has been previously indicated, the soft wheels are inboard of the harder plastic bodies. The number of cars on a team may be increased by adding an additional towed drone 50 behind the first drone.

While a particular embodiment of the present invention has been shown and described with some modifications, further changes and modifications will occur to those skilled in the art. It is intended in the appended claims to cover all such changes and modifications as fall within the true spirit and scope of the present invention.

What is claimed as new and desired to be secured by Letters Patent is:

1. A toy race set comprising:

a motorized toy lead vehicle having a wheel base of a predetermined length;

a freewheeling toy follower vehicle having a wheel base substantially the same length as the wheel base of the lead vehicle;

a resilient link of a length greater than the length of the wheel base of either vehicle; and means connecting the link adjacent one end to the back of the motorized vehicle and adjacent the other end to the front of the free wheeling vehicle.

2. A toy race set comprising:

a motorized toy lead vehicle;

a track having a slot;

a depending guide pin on the motorized vehicle engaging the slot;

a freewheeling toy follower vehicle;

a resilient link; and means connecting the link adjacent one end to the back of the motorized vehicle and adjacent the other end to the front of the free wheeling vehicle.

3. The toy race set of claim 2 in which the track has an upwardly extending sidewall.

4. The toy race set of claim 1 in which the link has a substantially greater width than thickness.

5. The toy race set of claim 4 in which the width is at least twice the thickness.

6. The toy race set of claim 1 in which the link is made of rubber.

7. The toy race set of claim 1 in which the link is made of black Kraton polymer 3200.

8. The toy race set of claim 7 in which the link has a hardness of Shore 70–75.

9. The toy race set of claim 2 in which the wheel base of the lead vehicle and the follower vehicle are substantially the same and the length of the link is greater than the wheel base.

10. The toy race set of claim 3 in which the cars have bodies made of a relatively hard plastic material and wheels made of a relatively soft, high coefficient of friction, material and the bodies extend outward of the wheels.

11. The toy race set of claim 1 in which the means connecting the link to the vehicle generally maintains the link in a fixed angular relationship to the vehicle at the connected end.

12. The toy race set of claim 1 in which the free wheeling vehicle has a body substantially the same as the body of the lead vehicle but without a motor and includes a weight added for stability to compensate for the omitted motor.

13. The toy race set of claim 2 in which the free wheeling vehicle includes a magnet that cooperates with the track for added stability.

14. The toy race set of claim 2 in which the link has a substantially greater width than thickness.

15. The toy race set of claim 14 in which the width is at least twice the thickness.

16. The toy race set of claim 2 in which the link is made of rubber.

17. The toy race set of claim 2 in which the link is made of black Kraton polymer 3200.

18. The toy race set of claim 17 in which the link has a hardness of Shore 70–75.

19. The toy race set of claim 2 in which the means connecting the link to the vehicle generally maintains the link in a fixed angular relationship to the vehicle at the connected end.

20. The toy race set of claim 2 in which the free wheeling vehicle has a body substantially the same as the body of the lead vehicle but without a motor and includes a weight added for stability to compensate for the omitted motor.

* * * * *